US007387309B2

(12) United States Patent
Pupko

(10) Patent No.: US 7,387,309 B2
(45) Date of Patent: Jun. 17, 2008

(54) SKI BINDING ADJUSTABLE FOR IMPROVED BALANCE

(76) Inventor: Michael M. Pupko, 9002 Sunset Dr., Colden, NY (US) 14033

( * ) Notice: Subject to any disclaimer, the term of this patent is extended or adjusted under 35 U.S.C. 154(b) by 417 days.

(21) Appl. No.: 10/530,859

(22) PCT Filed: Oct. 17, 2003

(86) PCT No.: PCT/US03/33107

§ 371 (c)(1),
(2), (4) Date: Apr. 8, 2005

(87) PCT Pub. No.: WO2004/035153

PCT Pub. Date: Apr. 29, 2004

(65) Prior Publication Data

US 2006/0119076 A1 Jun. 8, 2006

Related U.S. Application Data

(60) Provisional application No. 60/419,186, filed on Oct. 17, 2003.

(51) Int. Cl.
*A63C 9/00* (2006.01)

(52) U.S. Cl. ..... 280/617; 280/607; 280/611; 280/618

(58) Field of Classification Search ..... 280/605, 280/607, 11.14, 611, 614, 617, 618, 620, 280/623, 626, 631, 632, 633, 636
See application file for complete search history.

(56) References Cited

U.S. PATENT DOCUMENTS 3,675,938 A * 7/1972 Sigl ..... 280/636
4,002,354 A 1/1977 Ramer
4,007,946 A 2/1977 Sarver
4,083,576 A 4/1978 Von Besser (Continued)

FOREIGN PATENT DOCUMENTS

DE 2064754 7/1972

*Primary Examiner*—Christopher Ellis
*Assistant Examiner*—John D Walters
(74) *Attorney, Agent, or Firm*—James C. Simmons

(57) ABSTRACT

A mechanism for attaching a boot to a ski with the heel end of the boot being height adjustable. The toe end portion of the boot is pivotly attaching to the ski. A pair of members extend from the heel end portion and the ski respectively and have serrated surfaces which face each other with serrations in one surface engaging complementary serrations in the other surface at various heights of the heel end portion. The members are fastened together at various heights to which the heel end portion is adjusted. A track on the heel end portion is slidably engaged by the heel end portion member. Alternatively, a pair of members are pivotly attached to the ski along a common pivot axis and are drawn together and apart by a screw, and a track structure on the boot is slidably engaged by end portions of the members. A boot plate is pivotly laterally adjustable. An extension member is attachable to an end portion of the boot plate for increasing boot plate length. Ski brake height is adjusted by cutting off a ground engaging portion of the brake and by applying to a shank of the brake a tubular portion of a member from which extends a replacement ground engaging portion providing a different brake length commensurate with a changed heel height.

11 Claims, 6 Drawing Sheets

U.S. PATENT DOCUMENTS 4,085,947 A 4/1978 Sarver
4,094,529 A * 6/1978 Nasson ..... 280/614
4,135,335 A * 1/1979 Jensen ..... 52/126.1
4,135,736 A 1/1979 Druss
4,139,214 A 2/1979 Meyer
4,141,570 A 2/1979 Sudmeier
4,196,530 A 4/1980 Delery
4,288,093 A 9/1981 Krob et al.
4,353,575 A * 10/1982 Brice ..... 280/614
4,408,779 A * 10/1983 Shekter ..... 280/607
4,438,948 A * 3/1984 Gertsch ..... 280/618
4,586,727 A 5/1986 Andrieu et al.
4,725,069 A 2/1988 Stampacchia et al.
5,116,073 A * 5/1992 Goud ..... 280/617
5,394,627 A 3/1995 Eugler
5,560,633 A 10/1996 McGowan
6,065,895 A * 5/2000 Lehner et al. ..... 403/105
6,648,362 B1 11/2003 Bunter
6,808,196 B2 * 10/2004 Des Ouches ..... 280/636
2003/0155744 A1 * 8/2003 Gorza et al. ..... 280/618

* cited by examiner

FIG. 5
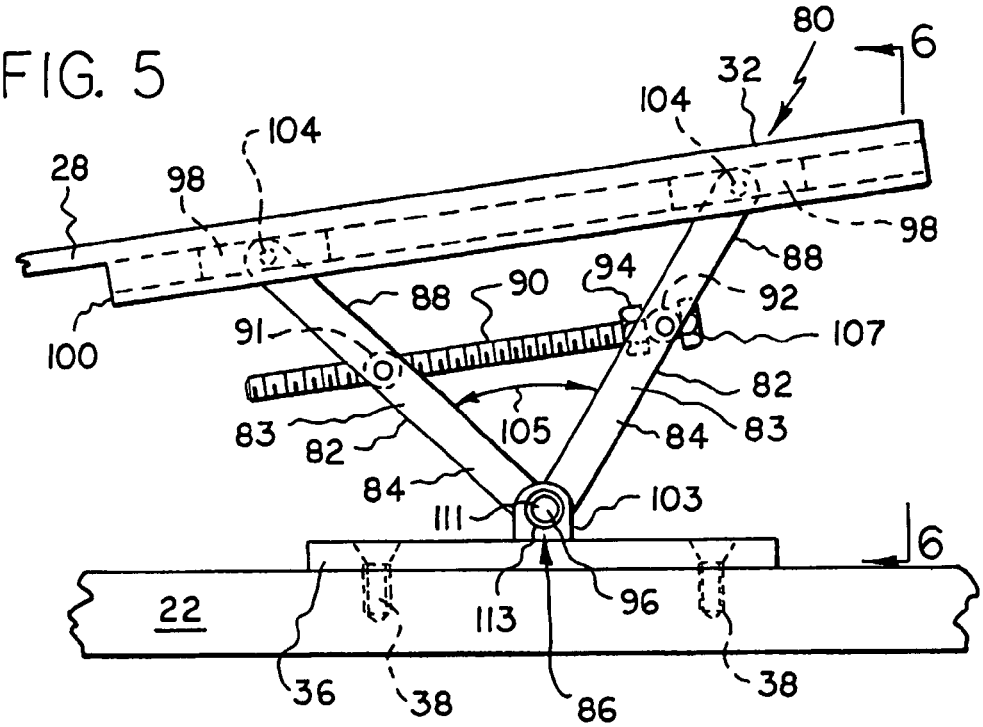
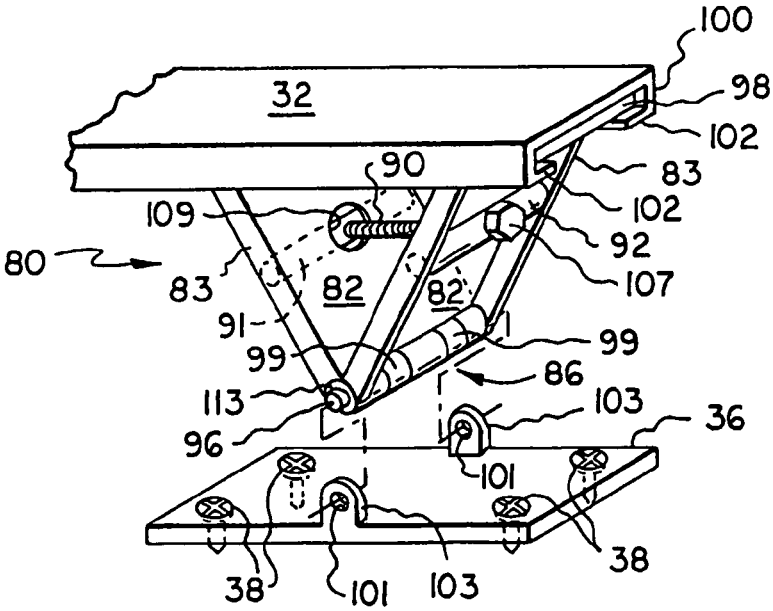
FIG. 6
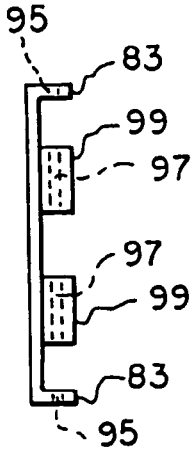
FIG. 6A

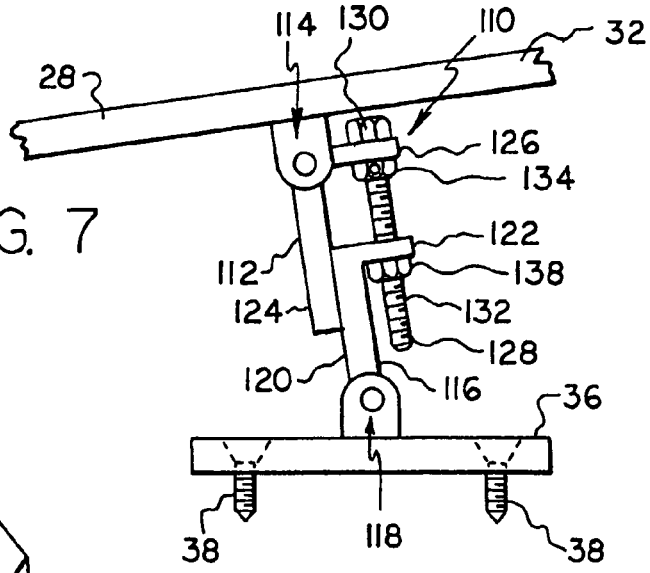
FIG. 7
FIG. 8
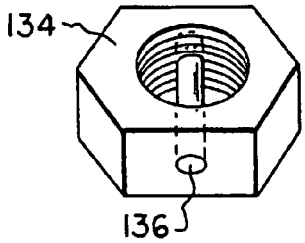
FIG. 9
PRIOR ART
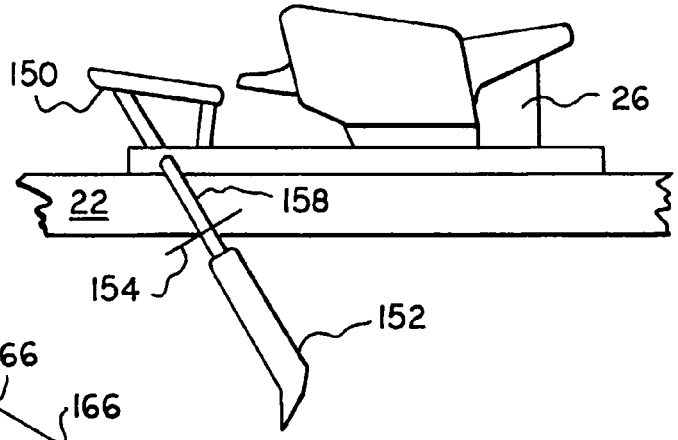
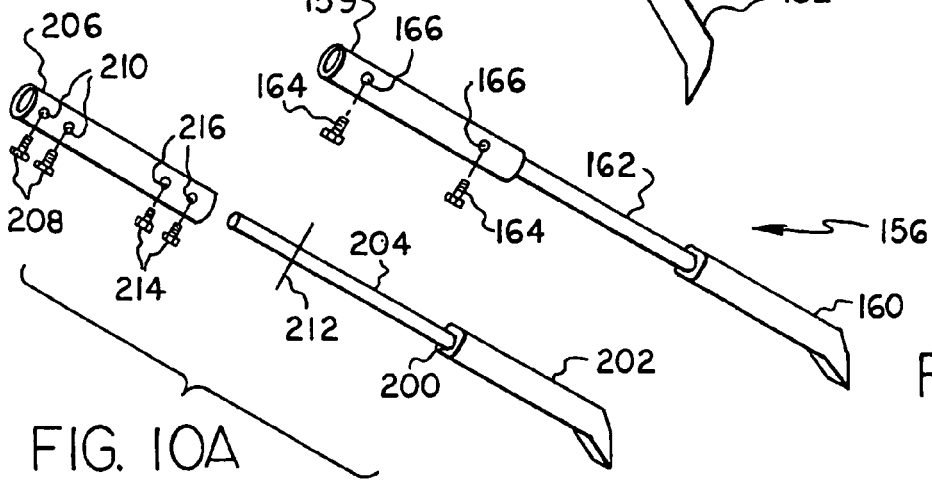
FIG. 10
FIG. 10A

SKI BINDING ADJUSTABLE FOR IMPROVED BALANCE

The disclosure of U.S. provisional patent application Ser. No. 60/419,186, filed Oct. 17, 2003 (the priority of which is claimed), is hereby incorporated herein by reference.

The present invention relates generally to ski bindings, i.e., mechanisms for attaching boots to skis.

Typical ski equipment set-ups leave many people in very poor fore/aft positions, i.e., leaving many people inclined too far backward. This makes it difficult to balance with the result that it is harder to learn to ski, more tiring, and the risk of injury is increased. To achieve better balance, the skier's feet should often be inclined relative to the skis so that the heel is raised relative to the height of the toes. The correct fore and aft position will vary depending on the skier's body type. It is thus considered desirable for a skier to be able to adjust his or her fore and aft position to achieve the correct balance for him or her.

U.S. Pat. No. 4,007,946 to Sarver discloses in FIG. 8 thereof a ski having a height-adjustable heel device for elevating the heel of a skier's boot. The device has a pair of "scissors" members pivotly connected to the underside of a plate to which the boot attaches, and a screw mechanism connected to the ski spreads or contracts the members to lower or raise respectively the heel, the plate being pivotly mounted at the toe end thereof to the ski. Such a device may be "wobbly" and not provide the desired stability.

U.S. Pat. No. 4,135,736 to Druss, which is incorporated herein by reference, discloses a boot binding ski assembly having front and rear rests with the binding, illustrated at 82 in FIG. 12 thereof, positioned at the center. An adjustable heel comprising an adjusting mechanism is provided for elevational positioning. Druss discloses in FIGS. 10 and 11 thereof a variation of the rear rest vertical members with cooperating teeth, illustrated at 86 and 88 therein, and two screws received in height adjusting slots to provide height adjustment of the heel. This is for taking up play between the boot and ski and accordingly has a very limited height adjustment.

U.S. Pat. No. 3,675,938 to Sigl discloses a ski with a boot platform which is inclinable by a pivot connection at its forward end and a mechanism for adjusting the height of the rear end. This height adjustment mechanism includes a stud to which a pin is welded, the pin being slideably received longitudinally in a recess, which is illustrated at 88 therein. The reason for the recess is stated, at column 3, lines 35 to 37, thereof to be to accommodate longitudinal adjustment of the position of the platform member and boot. Such a mechanism is "wobbly" and does not provide the desired stability.

U.S. Pat. No. 4,141,570 to Sudmeier discloses height adjustable connections at all four corners of the plate to which the boot is attached. Such a height adjustment mechanism is also undesirably very complex and has many moving parts.

Other art which may be of interest includes U.S. Pat. Nos. 4,085,947; 4,139,214; 4,353,575; and 4,586,727.

It is also important that the ski be able to flex as much as possible. The attachment of the adjusting screw mechanism of Sarver to the ski would undesirably inhibit flexion. The rigid plate, illustrated at 34 in FIG. 1 of Sigl, attached to the ski thereof would also undesirably inhibit flexion.

In order to improve ski flexion, bindings currently have been provided to be held in place on a ski at a single binding location (rather than both fore and aft binding locations) for movement in a track on the ski.

It is considered desirable to provide a stable and easy to use mechanism for making adjustment of a skier's fore and aft position much easier and in a large range to accommodate a maximum number of skiers regardless of body type. It is a goal to make the adjustment easy enough that most people could do it on their own on the slopes so that they can fine tune their positions to where they feel the most in balance.

It is accordingly a primary object of the present invention to provide an easy to use, uncomplicated and with a minimum of moving parts, stable, and reliable mechanism for adjusting the height of a skier's heel relative to the toes so that proper balance may be achieved by a maximum number of skiers regardless of body type.

It is a further primary object of the present invention to provide such an adjustment mechanism while eliminating or minimizing any reduction in ski flexion, thereby enhancing the ability of the ski to flex evenly.

In order to provide such an easy to use, stable, uncomplicated, reliable mechanism, in accordance with the present invention, the toe binding for a boot (by means of a plate attached thereto or otherwise) is pivotably attached to a ski, and the heel binding for the boot is attached to the ski by a pair of members attached to the heel binding (by means of the plate attached thereto or otherwise) and ski respectively and having complementary serrations for interlockingly engaging each other at various adjusted positions of one of the members relative to the other thereof for adjustment of the heel height and at least one fastener for connecting the members at any of the various heights to which the heel is adjusted. In order to eliminate or minimize any reduction in ski flexion, in accordance with the present invention, the upper one of the members is slidably connected to the heel end portion of the plate (or otherwise the boot).

In order to provide such an easy to use, stable, uncomplicated, reliable mechanism, in accordance with the present invention, the toe binding for a boot (by means of a plate attached thereto or otherwise) is pivotably attached to the ski, and the heel binding for the boot is attached to the ski by a pair of members lower end portions of which are pivotly attached to the ski, and the upper end portions of which are attached to the heel binding (by means of the plate attached thereto or otherwise), and a screw draws the members together and apart. In order to eliminate or minimize any reduction in ski flexion, in accordance with the present invention, the upper end portions of the members are slidably connected to the heel end portion of the plate (or otherwise the boot).

The above and other objects, features, and advantages of the present invention will be apparent in the following detailed description of the preferred embodiments thereof when read in conjunction with the appended drawings in which the same reference numerals depict the same or similar parts throughout the several views.

BRIEF DESCRIPTION OF THE DRAWINGS

FIG. 5 is a view similar to that of FIG. 1 of a ski binding in accordance with another alternative embodiment of the present invention.

FIG. 6 is a view thereof taken along lines 6-6 of FIG. 5.

FIG. 6A is a top view of one of a pair of brackets for the ski binding of FIG. 5.

FIG. 7 is a view similar to that of FIG. 1 of a ski binding in accordance with another alternative embodiment of the present invention.

FIG. 8 is a perspective view of a nut used in the binding of FIG. 7.

FIG. 9 is a schematic view showing a conventional ski brake for the ski.

FIG. 10 is a perspective view of an attachment to the ski brake for use when using the present invention.

FIG. 10A is a view similar to that of FIG. 10 of an alternative embodiment of the attachment.

DETAILED DESCRIPTION OF THE PREFERRED EMBODIMENTS

Figure 1:
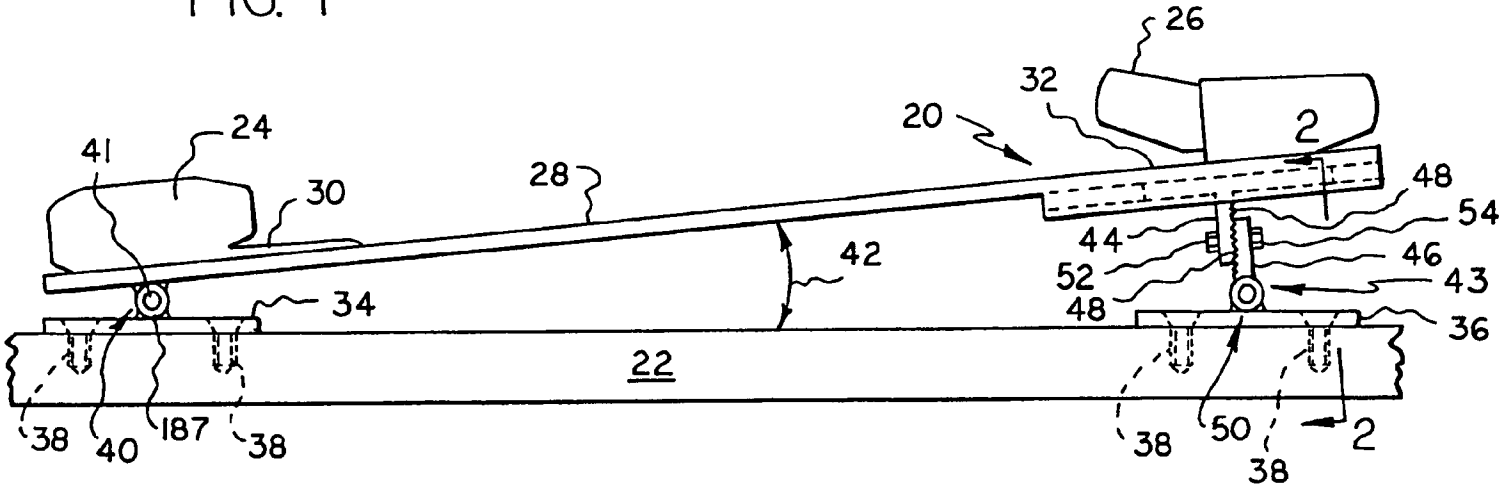
FIG. 1 is a side schematic view of a ski binding according to the present invention.
Figure 2:
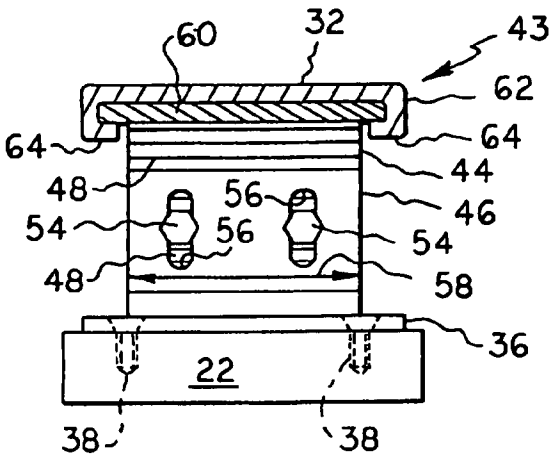
FIG. 2 is a view thereof taken along lines 2-2 of FIG. 1.

Referring to FIGS. 1 and 2, there is shown generally at 20 a mechanism for attaching a boot to a ski 22, the toe and heel binding being conventional and illustrated at 24 and 26 respectively and corresponding to the toe and heel portions respectively of a boot to be attached to the ski 22. It is of course to be understood that the attachment of a boot to a ski, in accordance with the present invention, is via the use conventionally of bindings, as discussed hereinafter.

The mechanism 20 includes an elongate plate 28 to which the bindings 24 and 26 are suitably and conventionally attached in accordance with principles commonly known to those of ordinary skill in the art to which the present invention pertains, the plate 28 having a toe end portion 30 to which the toe binding 24 is attached and a heel end portion 32 to which the heel binding 26 is attached. The plate 28 has a width and length equal generally to the width and length of the bindings for the boot to be bound thereto (which is generally equal to the width and length of the boot).

For purposes of providing a means for attachment of the elongate plate end portions 30 and 32 to the ski 22, as hereinafter discussed, corresponding plates 34 and 36 respectively are fixedly attached to the ski 22 such as by screws 38 or other suitable means. The width of each of the plates 34 and 36 is generally equal to the width of the elongate plate 28, and the length of each of the plates 34 may, for example, be generally equal to the width thereof, or otherwise as suitable. Each plate 34 and 36 may, for example, have 4 of the screws 38, one at each corner, or other suitable number of screws.

The toe end portion 30 is pivotly connected to the plate 34 by a conventional pivot or hinged connection, illustrated at 40, including a hinge pin 41, to allow the elongate plate 28 to be adjusted through the angle illustrated at 42 so that the height of the skier's heel relative to the skier's toes may be adjusted to achieve the optimum balance for the particular skier. The hinged connection 40 may, for example, be similar to the hinged connection illustrated in the aforesaid U.S. Pat. No. 4,353,575 and discussed at column 3, lines 1 to 5, thereof, which patent is hereby incorporated herein by reference. For another example, the hinged connection may be similar to a conventional door hinge, such as shown at 86 in FIGS. 5 and 6. In order to accommodate most skiers, the angle 42 is preferably adjustable up to at least about 10 degrees.

In order to provide an easy to use, stable, uncomplicated, reliable means for adjustment of the height of the heel end portion 32 relative to the toe end portion 30 through the angle 42, in accordance with the present invention, a height adjustment assembly, illustrated generally at 43, is provided wherein the heel end portion 32 is attached to the ski plate 36 by upper and lower members 44 and 46 respectively having complementary teeth or serrations, illustrated at 48, on facing sides for interlockingly engaging each other. The lower serrated member 46 is pivotly attached to ski plate 36 by a conventional pivot or hinged connection, illustrated at 50, which may be similar to hinged connection or otherwise as suitable. The upper serrated member 44 is attached to the elongate plate heel end portion 32 as hereinafter discussed. The members 44 and 46 are fixedly attached at an adjusted position by at least one but preferably a pair of bolts 52 and corresponding nuts 54 or other suitable fasteners, the shanks of the bolts 52 received in apertures (not shown) in member 44 and in vertically elongated adjustment slots, illustrated at 56, in the other member 46. It should be evident that the adjustment slots 56 may be provided in either of the members 44 and 46 and that the bolts 52 and nuts 54 may be interchanged. It should also be understood that either the bolt heads or the nuts may desirably be conventionally fixed to the respective member so as to be free from turning thereby making height adjustment easier for the skier. The width, illustrated at 58, of each of the members 44 and 46 is generally equal to the width of the elongate member 28 to thereby provide stability. Thus, it can be seen that the members may be attached by the bolts 52 and nuts 54 at any of various heights to which the heel portion 32 is to be desirably adjusted, with the serrations 48 on the upper member 44 bearingly and interlockingly engaging the complementary serrations 48 on the lower member 46 to stably provide the needed support. The serrations 48 are desirably sized, in accordance with principles commonly known to those of ordinary skill in the art to which the present invention pertains, to provide height adjustments of, for example, as little as ⅛ degree.

It is important that the ski 22 be able to flex as much as possible to make turning easier, and modern skies are typically constructed to maximize their flexing ability. During flexing of the ski, the distance between the plates 34 and 36 varies. In order to compensate for this variance in distance so that the ski 22 may be enabled to sufficiently flex as well as to evenly flex, the upper serrated member 44 is slidably attached to the heel portion 32 by an overhanging upper portion 60 of upper member 44 which is slidably received in a track, illustrated at 62, on the lower surface of heel portion 32. The track 62 comprises a pair of underhang portions 64 which are spaced apart a distance which is less than the width of the member overhanging portion 60 so that the portion 60 is retained slidably within the track 62. The track 62 may be open-ended at one or both ends to allow the member portion 60 to be inserted into the track 62 and is desirably long enough so that the member portion 60 does not come out of the track 62 during skiing.

In order to adjust the angle 42 so as to adjust the height of the skier's heel relative to the toes for improved balance as well as to achieve increased leverage, even while on the ski slopes, the skier may easily and quickly loosen the nuts 54, incrementally raise or lower the upper member 44 relative to the lower member 46, tighten the nuts 54 on the bolts 52 to firmly secure the members 44 and 46 in the newly adjusted position, and then go about enjoying skiing even more at the improved balance and leverage and with the upper member portion 60 sliding within the track 62 so that flexing of the ski for better turning is not unduly hampered.

It should be understood that the boot and ski plates 28, 34, and 36 are not essential to the present invention and that the toe binding 24 may be directly or otherwise pivotly connected to the ski 22 and the serrated members 44 and 46 directly or otherwise connected to the heel binding 26 and ski 22 respectively. The device of the present invention need not be a separate device but may instead be built into the ski and/or binding. Thus, a reference to the toe or heel end portion or to a ski in the claims is meant to also refer to plates attached or attachable thereto.

Figure 3:
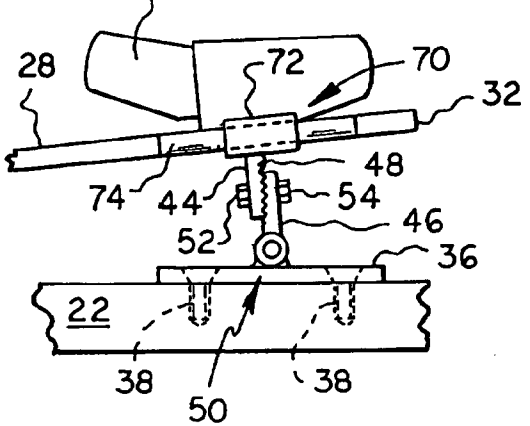
FIG. 3 is a partial view similar to that of FIG. 1 of a ski binding in accordance with an alternative embodiment of the present invention.
Figure 4:
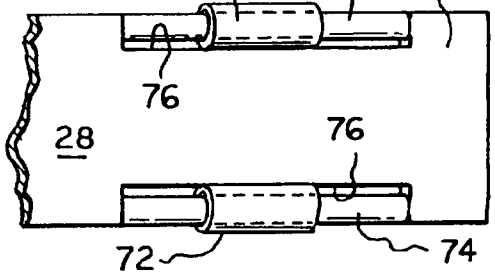
FIG. 4 is a partial perspective view of the boot plate thereof.

Referring to FIGS. 3 and 4, there is shown generally at 70 an alternative embodiment of the height adjustment assembly. The assembly 70, like the assembly 43 of FIGS. 1 and 2, comprises upper and lower serrated members 44 and 46 respectively attached by fasteners 52 and 54 and with the lower serrated member 46 pivotly mounted to the ski plate 36. In accordance with this alternative embodiment, the upper serrated member 44 is slidably attached to the heel end portion 32 of the boot plate 28 by a pair of tubular portions 72 suitably formed or otherwise attached on opposite sides respectively of the upper serrated member 44 and a pair of round rods 74 suitably formed or otherwise attached in cut-outs 76 respectively on opposite sides respectively of the heel end portion 32 of the boot plate 28 and which are slidably received in the tubular portions 72 respectively.

Referring to FIGS. 5, 6, and 6A, there is shown generally at 80 an alternative embodiment of the height adjustment assembly. The assembly 80 comprises a pair of channel members 82 having side flanges 83 and the lower end portions 84 of which are pivotly attached to the ski plate by a suitable conventional pivot or hinge assembly 86, which is shown to be similar to a conventional door hinge. Thus, a hinge pin or pivot rod 96, providing a common pivot axis, is suitably received in apertures, illustrated at 95, in the side flanges 83 of each of the members 82 and in apertures, illustrated at 97, in alternate eyelet or tubular portions 99 on the bottom edges of the members 82, and at each end the hinge pin 96 is received in apertures, illustrated at 101, in eyelet members 103 which are welded or otherwise suitably attached to plate 36. The pin 96 is desirably (but not required to be) secured against removal from the hinge by suitable means such as, for example, a head 111 and washer 113 on one end and a nut (not shown) and washer (not shown) at the other end. Thus, the structural members 82 may be pivotly spread apart or contracted, as illustrated at 105 in FIG. 5, by pivotal movement on the hinge pin 96.

The upper end portions 88 of the members 82 are attached to the heel end portion 32 of plate 28, as hereinafter discussed. Intermediate the height of the members 82, elongate members 91 and 92 such as bars or tubular members are mounted to extend between the respective flanges 83 of the members 82 respectively and are suitably attached to the respective flanges 83 such as by screws (not shown) so that they can pivot (i.e., are rotatable about the longitudinal axis). The head end portion 107 of an adjustment bolt or screw 90 is received in an unthreaded aperture in member 92 and a nut 94, similar to nut 134 in FIG. 8, placed thereon so that the screw 90 rotates in place with the member 92 sandwiched between the bolt head and the nut 94. The screw 90 is threadedly received in a threaded aperture centrally located in rotatable member 91 to draw the members together or apart, as illustrated at 105) to increase or decrease respectively the distance between the plates 28 and 36 and thereby adjust the heel height, the members 91 and 92 being rotatable (pivotal) to allow alignment of the apertures therein during adjustment. Suitable openings, illustrated at 109 for one of the channel members, are provided in the channel members 82 for unfettered passage of the screw 90. The upper portion 88 of each of the members 82 is pivotably attached to an overhanging member 98 by means of a pin 104 or other suitable pivoting device. In order to allow the ski 22 to be able to sufficiently flex, these upper portions 88, similarly as shown in FIG. 2, are slidably attached to the heel portion 32 by the pivotly-connected overhanging members 98 being slidably received in a track, illustrated at 100, on the lower surface of heel portion 32. The track 100 comprises a pair of underhang or rail portions 102 which are spaced apart a distance which is less than the width of each of the overhanging members 98 so that the overhanging members 98 are retained slidably within the track 100. The track 100 may be open-ended at one or both ends to allow the members 98 to be inserted into the track 100 and is desirably long enough so that the members 98 do not come out of the track 100 during skiing.

The placement of an adjustment screw so that it is rigidly attached to the ski at the ski end of the "scissors" members, as in the aforesaid U.S. Pat. No. 4,007,946, detracts from the ability of the ski to flex as needed. Thus, in accordance with the present invention, the hinge 86 is instead placed at the ski plate 36. In order to provide increased stability, the "scissors" members 82 have a width which is generally equal to the width of each of plates 28 and 36.

The present invention is not limited to the particular components for the height adjustment assembly, which components are disclosed for exemplary purposes only. Thus, the present invention may be otherwise embodied for providing the desired height adjustment while allowing the ski to suitably flex. For example, the member 82 on the right side in FIGS. 5 and 6 may be removed, its corresponding elongate member 92 suitably mounted to the track 100 (or plate 32) so that it can pivot (i.e., rotate about its longitudinal axis), and elongate member 91 positioned to also serve as pin 104. This alternative assembly would thus allow pivoting at 104 and at the hinge 86 for height adjustment while also still allowing the ski to suitably flex.

Referring to FIGS. 7 and 8, there is shown generally at 110 an alternative embodiment of the height adjustment assembly. The assembly 110 comprises a member 112 pivotly mounted at pivot assembly 114 to the boot plate end portion 32 and another member 116 pivotly mounted at pivot assembly 118 to the ski plate 36. The pivot assemblies 114 and 118 may each be similar to hinge 50. Member 116 has a portion 120 which extends upwardly from hinge 116 to a point midway between the plates 28 and 36 and a portion 122 extends therefrom generally normal thereto. Member 112 is similarly shaped; a portion 124 terminates at a point midway between the plates 28 and 36 and has a track (not shown) on each side (similar to track 100 in FIGS. 5 and 6)

in which is slidably received member 116 to act as a backing or support for member 116 to thereby provide increased stability, and another portion 126 extends from the hinge 114 and generally normal to portion 124. Thus, as seen in FIG. 7, the portions 122 and 126 are generally parallel to each other and spaced vertically so that by drawing them together or apart the heel height may be adjusted. Adjustment is provided by a pair of bolts or screws 128 (one on each side, only one shown) having a head 130 and the shank 132 of which is received in an aperture in portion 126 and a nut 134 applied thereto so that the portion 126 is disposed between the bolt head 130 and the nut 134. The nut 134, as seen in FIG. 8, has a roll pin 136 which passes centrally through the nut (normal to the nut axis) and is received in an aperture in the shank 132 whereby the bolt 128 cannot be moved axially but can be turned for providing height adjustment. The shank 132 is threadedly received in a threaded aperture in the portion 122. A locknut 138 is provided on the shank 132 to lockingly bear against the underside of the portion 122. Thus, by turning the bolt head 130, the vertical distance between the portions 122 and 126 may easily, even while on the ski slopes, be increased or decreased to adjust the heel height. Each of the members 112 and 116 has a width generally equal to that of plates 28 and 36 to provide good stability. Since it is envisioned that the assembly 110 may be difficult to mount as shown, it is believed that it may be more easily mounted at the rear edge of plate 28.

FIG. 9 shows a conventional ski brake 150 applied to the ski 22. When the heel height is adjusted as described herein, the ground engaging portion 152 of the brake 150 may be too high. In order to accommodate for the increased height, in accordance with the present invention, the portion 152 is cut off, as illustrated at 154, and an adaptive ground engaging portion, illustrated generally at 156 in FIG. 10, applied to the shank 158 of the brake 150. The adaptive portion 156 comprises a tubular portion 159 in which the shank 158 is received, a ground engaging portion 160, which is similar to the cut-off portion 152, and a shank portion 162 for increasing the overall shank length to thereby position the ground engaging portion 160 lower to compensate for the increased heel height. The tubular portion 159 is suitably attached to the shank portion 158 by a pair of axially spaced screws 164 received in apertures 166 in the tubular portion 159 and screwed into the shank portion 158 or by other suitable means. The length of the shank portion 162 may, for example, be about 2 inches.

Referring to FIG. 10A, in accordance with an alternative embodiment of the present invention, in order to provide for adjustment of the length of the shank portion 162 to allow more precise brake height adjustment, an adapter member 200 having a ground engaging portion 202 and a shank portion 204 is attached to the shank portion 158 by a separate tubular portion 206. The term "ground," as used herein and in the claims, is meant to include "snow." One end of the tubular portion 206 is slipped over the remaining shank portion 158 and attached thereto by a pair of axially spaced screws 208 received in apertures 210 respectively in the separate tubular portion 206 and screwed into the shank portion 158 or by other suitable means. The shank portion 204 is cut, as illustrated at 212, to achieve the desired brake length, and the remainder of the shank portion 204 is then received in the other end of the tubular portion 206 and attached thereto by another pair of axially spaced screws 214 received in apertures 216 respectively in the separate tubular portion 206 and screwed into the shank portion 204 or by other suitable means.

Figure 11:
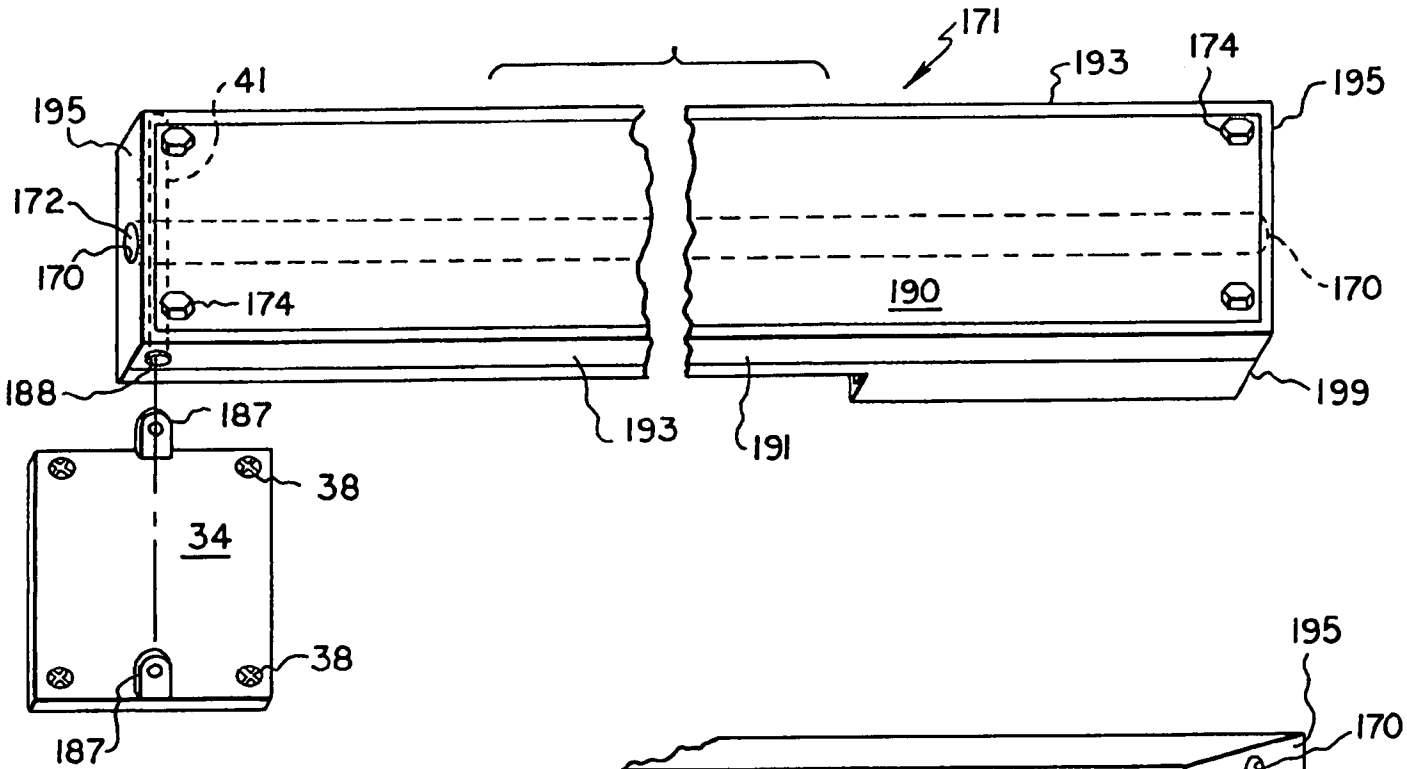
FIG. 11 is a perspective expanded view of a lateral adjustment mechanism which may be used with the present invention.
Figure 13:
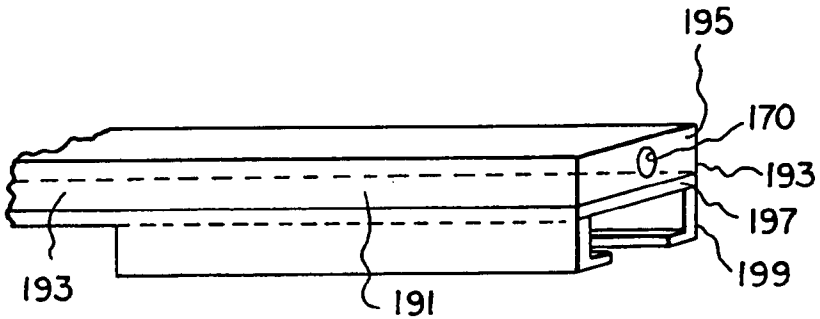
FIG. 13 is a perspective view of the other end portion of the adjustment mechanism.
Figure 12:
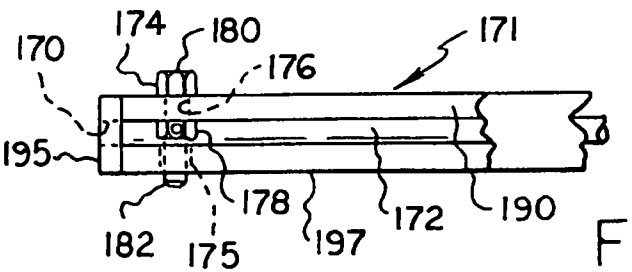
FIG. 12 is a side view, with a side wall of the housing removed, of an end portion of the adjustment mechanism.

Referring to FIGS. 11, 12, and 13, there is shown generally at 171 a lateral adjustment assembly for plate 190, which plate serves the same function (attachment of bindings) as plate 28 in FIG. 1. The lateral adjustment assembly 171 includes a housing 191 having side walls 193 joined by end walls 195 and a floor 197, the plate 190 being received over and spaced from the floor 197 and within the boundaries of the walls 193 and 195. For increased structural integrity, the floor 197 extends entirely over the length of the assembly 171, but it is not required that it do so. For example, floor portions may be provided at each end of the assembly 171 for purposes which will become apparent. An elongate rod 172 extends length-wise of the assembly 171 centrally of the width thereof, and the plate 190 rests thereon. The rod 172 is suitably fixedly received in and non-rotatably attached in a pair of apertures, illustrated at 170, in the end walls 195 respectively to allow the plate 190 to tilt laterally about the rod 172. Alternatively, the rod 172 may be mounted so as to be rotatable within the apertures 170, and the plate 190 may be attached fixedly to the rotatable rod. The lateral adjustment assembly 171 is provided to allow the plate 190 to be adjusted, for example, plus or minus about 3 degrees laterally to adjust the position laterally of the skier on the ski. A bolt or screw 174 is received in an unthreaded aperture 176 in each corner of the plate 190, and a nut 178 is screwed onto the bolt 174 so that the plate 190 is sandwiched between the bolt head 180 and the nut 178, and a roll pin (similarly as shown for roll pin 136 in FIG. 8) is inserted through the nut 178 and bolt shank 182 whereby the bolt 174 is prevented from vertical movement but can be turned to provide lateral adjustment. The bolt 174 is threadedly received in a threaded aperture, illustrated at 175, in the floor 197, whereby, by manipulation of the bolts 174 (i.e., by screwing inwardly on the bolts on one side of the plate 190 and by screwing outwardly a corresponding amount the bolts on the other side thereof), the lateral orientation of the plate 190 may be adjusted. The housing 191 is formed to have a track 199, similar to tracks 62 and 100, depending downwardly from the rear end portion thereof for rear height adjustment, and apertures 188 for receiving the pivot pin 41 (with the eyelet members 187 of plate 34 being disposed outwardly of the side walls 193 respectively) for pivotal movement of the assembly 171 at the forward end thereof.

Figure 15:
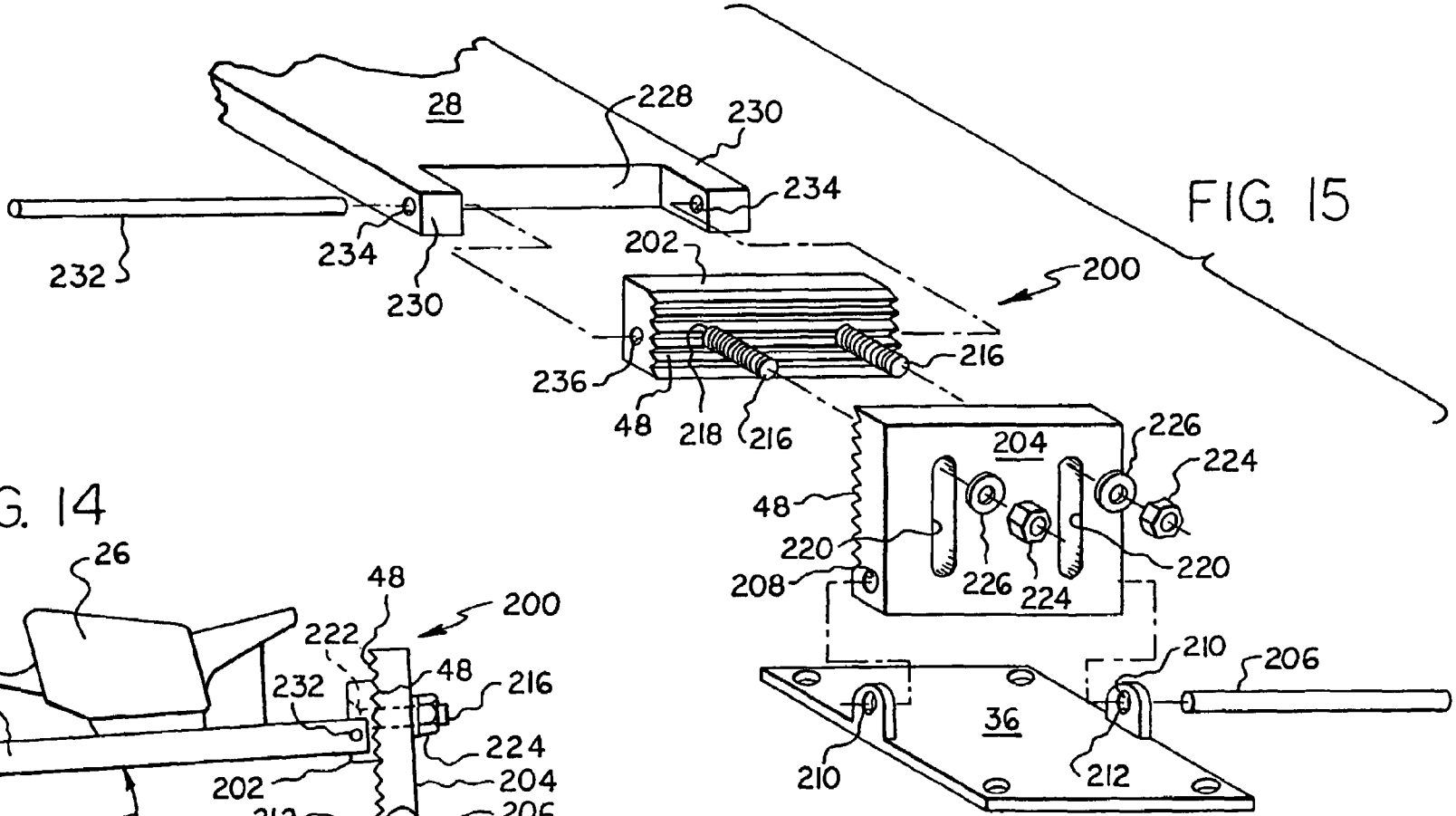
FIG. 15 is an exploded view of the height adjustment mechanism for the binding of FIG. 14.
Figure 14:
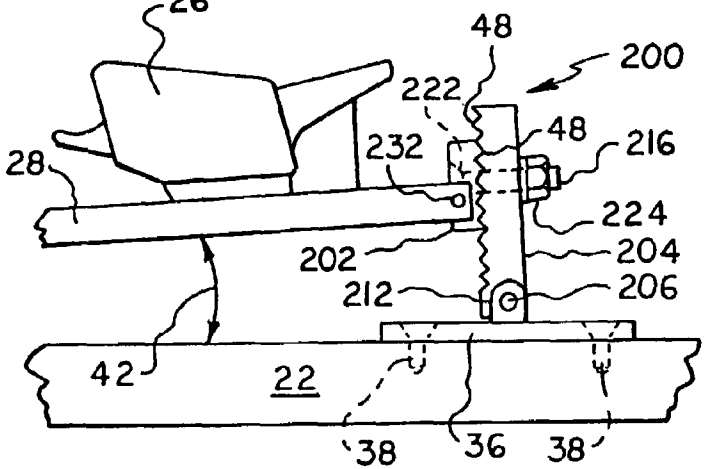
FIG. 14 is a partial view similar to that of FIG. 1 of a ski binding in accordance with another alternative embodiment of the present invention.

Referring to FIGS. 14 and 15, there is shown generally at 200 a height adjustment mechanism in accordance with an alternative embodiment of the present invention, the toe end portion having a hinged connection similar to that shown at 40 in FIG. 1. Height adjustment is provided by a pair of members 202 and 204 having the complementary teeth or serrations 48, similarly as shown for the assembly 43 of FIG. 1, on facing sides for interlockingly engaging each other. The member 202 is pivotly attached to the boot plate 28 as hereinafter described. The member 204 is pivotly attached to ski plate 36 by a hinged connection 50 similarly as shown for FIG. 1, including a hinge pin 206 which is received in an aperture, illustrated at 208, extending through a lower portion of the member 204 and through apertures, illustrated at 210, in eyelet members 212 protruding from opposite sides of the plate 36. Similarly as shown in FIG. 2, the members 202 and 204 are adjustably connected by a pair of screws 216 receivable in laterally spaced countersunk apertures, illustrated at 218, in member 202 and in laterally spaced vertically elongate apertures, illustrated at 220, in member 204, the head of one of the screws 216 illustrated at 222, and nuts and washers therefor illustrated at 224 and 226 respectively. Thus, the member 204 may be moved upwardly or downwardly relative to member 202 then fixed at an adjusted position by the interlocking serrations 48 engaging and by tightening of the nuts 224 on the screws 216 with the serrations interlocking with each other.

In accordance with a preferred embodiment of the present invention, in order to be able to adjust the angle 42 to a very small angle approaching zero degrees, the member 202 is pivotly attached to the rear end of the plate 28. Thus, the rear end of the plate 28 has a cut out, illustrated at 228, therein providing a pair of laterally spaced rearwardly extending protrusions 230. The member 202 is received in the cut out 228, and a pivot rod 232 is received in apertures, illustrated at 234, in the protrusions 230 and in an aperture, illustrated at 236, in the member 202. It should of course be understood that variations may be made in the assembly 200 as well as the other assemblies discussed herein. For example, instead of a single pin 232 or a single pin 206, a pair of short pins may be provided, each received on one side or the other of the respective member 202 and 204.

Figure 16:
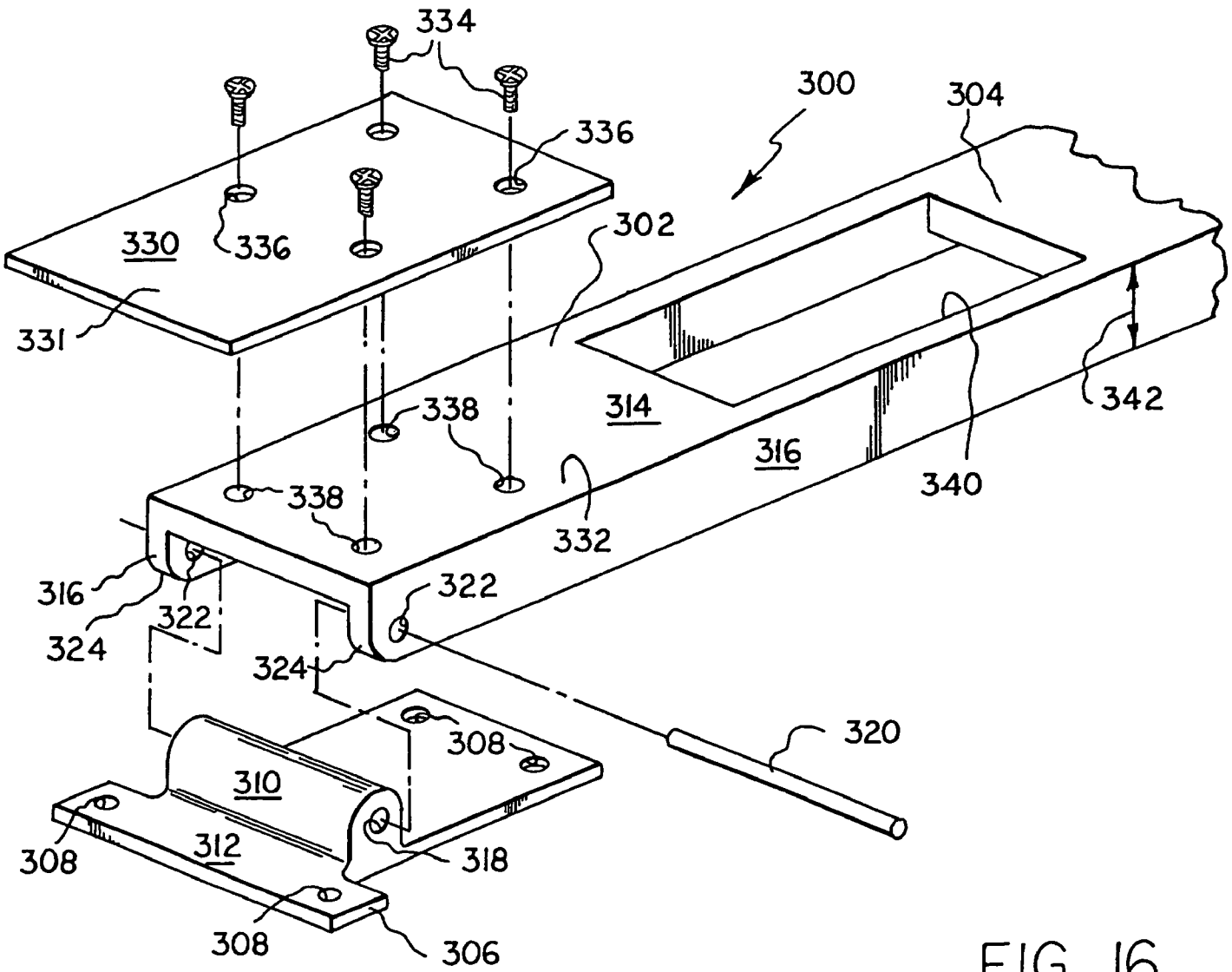
FIG. 16 is an exploded view of a binding attachment plate (partially shown) in accordance with another embodiment of the present invention, in combination with a toe end pivot structure.

Referring to FIG. 16, there is shown generally at 300 a plate to which toe and heel bindings 24 and 26 (not shown in FIG. 16) are attached and which is height adjustably attachable to a ski 22 as discussed hereinbefore. The plate 300 has a toe end portion 302 and a heel end portion 304 which are similar to the toe and heel end portions 30 and 32 respectively of FIG. 1. The plate 300 includes a generally flat portion 314 upon which the bindings are attached and a pair of flange portions 316 extending downwardly from the lateral edges of the flat portion 314. The toe end portion 302 is pivotly attached to a plate 306 which is in turn attached to the ski 22 by screws such as screws 38 in FIG. 1 received in apertures, illustrated at 308, in the plate 306 and threadedly received in apertures in the ski 22. The plate 306 is formed to have an upstanding tubular hinge portion 310, i.e., having a bore, illustrated at 318, extending laterally of the plates 300 and 306 therethrough. Forward of the hinge portion 310 is an increased width portion 312 of the plate 306, i.e., a portion which generally extends to the lateral edges of the ski 22. While shown to be integrally formed with the plate 306, it should be understood that the hinge portion 310 may be a separate member which is welded or otherwise suitably secured to the plate 306. In order to pivotly attach the forward end of the bindings or boot plate 300 to the ski plate 306, a hinge pin 320 is received in the bore 318 and in apertures, illustrated at 322 in the forward ends of the flange portions 316. The flange portions 316 have rounded lower forward end corners, illustrated at 324, in order to provide clearance with plate portion 312 during pivoting movement thereof. The plate 306 is of reduced width relative to the portion 312 thereof so as to be able to fit between the flange portions 316.

Race plates have been provided to raise the boots and bindings above the skis for greater leverage. In order to accommodate almost any size boot, these race plates are often made long, for example, 24 inches. Thus, if plate 300 were 24 inches long, it would accommodate the boots of all or almost all skiers. However, since the plate 300 must be of sufficient thickness to suitably accommodate forces acting thereon, such a length undesirably increases the weight thus undesirably increasing the burden of carrying the skis, especially for smaller people who have boot sizes which do not require such long plates. In order to reduce the carrying burden on smaller (as well as larger) persons while also accommodating larger boot sizes of larger persons, in accordance with the present invention, the bindings plate 300 is made to a relatively smaller length of, for example, 18 inches, and a decreased thickness extension 330 is attached to the top surface of flat plate portion 314 at the forward end portion 332 thereof to increase the length thereof by, for example, about 2 inches, to 20 inches overall. If desired, the extension may be provided to increase the length thereof by, for example, about 4 inches or longer, to 22 or more inches overall. The extension 330 is attached to the plate 300 by screws 334, for example, 4 no. 10-32 flat head screws, received in counterbored (to accommodate the flat heads) apertures, illustrated at 336, in the rearward end portion of the extension 330 and threadedly received in threaded apertures, illustrated at 338, in the forward end portion 332 of the flat plate portion 314. The forward end portion 331 of the lighter (less thickness) extension thus extends forwardly beyond the plate 300 to increase the overall plate length by as much as 2 or more inches.

Snow may tend to build up and cake between the plate 300 and the ski 22. This is a type of problem which used to be encountered under boots with the solution in recent years being that the soles of boots have been conventionally contoured to allow the escape of the snow. In order to allow snow to escape from between the plate 300 and the ski 22 as well as to reduce the carrying burden even more for both small and large people, a lightening cutout, illustrated at 340, is provided centrally of the length of the plate 300 (between the attachments of the bindings). While the cutout 340 is shown to be rectangular in shape, it should be understood that it may otherwise be suitably shaped or provided in other ways such as a series of apertures.

The following dimensions of the plate 300 and extension 330 as well as other dimensions and examples contained herein (unless the context clearly indicates otherwise) are for exemplary purposes only and not for purposes of limitation. The overall length and width of plate portion 314 may, for example, be about 18 inches and about 2¼ inches respectively. The flange portion height, illustrated at 342, may, for example, be about ½ inch. The thickness of each of the plate and flange portions 314 and 316 respectively may, for example, be about ¼ inch. The extension 330 may have a length, width, and thickness of about 4 inches, about 2¼ inches, and about 3/16 inch respectively and is attached to the plate 300 so as to extend, for example, about 2 inches forwardly thereof. The cutout 340 begins, for example, about 4½ inches from the forward edge of the plate 300, extends lengthwise of the plate 300 a distance of, for example, about 4 inches, and extends widthwise, for example, over the entire distance between the flange portions 316. The plates 300, 306, and 330 are made of aluminum or other suitable material.

It should be understood that, while tracks such as at 62 in FIG. 2 or 74 in FIG. 4 are shown on the boot plate (and of course may alternately be directly on the boot), they may alternatively be on the ski plate or directly on the ski.

It should be understood that, while the present invention has been described in detail herein, the invention can be embodied otherwise without departing from the principles thereof, and such other embodiments are meant to come within the scope of the present invention as defined by the appended claims.

What is claimed is:

1. A mechanism for attaching a boot to a ski, the mechanism comprising structure for pivotly attaching a toe end portion of the boot to a ski and structure for height adjustably attaching a heel end portion of the boot to the ski, said height adjusting structure comprising a pair of members extendable from the heel end portion and the ski respectively and having surfaces respectively for facing each other, each of said members having a plurality of serrations in said respective surface for engaging complementary ones of said serrations in said surface of an other of said members at various heights of the heel end portion, and at least one fastener for connecting said members at various heights of the heel end portion.

2. A mechanism for attaching a boot to a ski, the mechanism comprising structure for pivotly attaching a toe end portion of the boot to a ski and structure for height adjustably attaching a heel end portion of the boot to the ski, said height adjusting structure comprising a pair of members extendable from the heel end portion and the ski respectively and having surfaces respectively for facing each other, each of said members having plurality of serrations in said respective surface for engaging complementary ones of said serrations in said surface of an other of said members at various heights of the heel end portion, at least one fastener for connecting said members at various heights of the heel end portion, and a track on said heel end portion for slidably engaging an end portion of said member which is extendable from the heel end portion.

3. A mechanism according to claim 1 further comprising plates on the boot and ski respectively to which said height adjusting structure is pivotly attached.

4. A mechanism according to claim 3 further comprising a cut out in a rear end of said boot plate, and said member extendable from the heel end portion being pivotly attached in said cut out.

5. A mechanism according to claim 3 further comprising a pivot for laterally adjustably tilting said boot plate and at least one fastener for fixing said boot plate at a laterally adjusted position.

6. A mechanism according to claim 1 wherein each of said members has a width equal substantially to a width of the ski.

7. A mechanism for attaching a boot to a ski, the mechanism comprising structure for pivotly attaching a toe end portion of the boot to a ski and structure for height adjustably attaching a heel end portion of the boot to the ski, said height adjusting structure comprising a pair of members extendable from the heel end portion and the ski respectively and having surface respectively for facing each other, each of said members having a plurality of serrations in said respective surface for engaging complementary ones of said serrations in said surface of an other of said members at various heights of the heel end portion, at least one fastener for connecting said members at various heights of the heel end portion, a plate having bindings for attachment of the boot thereto, and an extension member attachable to an end portion of said plate for increasing plate length.

8. A mechanism according to claim 7 wherein said extension member is attached to a toe end portion of said plate.

9. A mechanism according to claim 7 further comprising at least one cutout in said plate for releasing snow from between said plate and the ski.

10. A mechanism according to claim 7 further comprising a pivot for laterally adjustably tilting said boot plate and at least one fastener for fixing said boot plate at a laterally adjusted position.

11. A mechanism according to claim 1 further comprising a replacement ground engaging brake portion for attachment to a shank of a ski brake after a ground engaging brake portion thereof has been cut off for providing a brake length commensurate with a different heel end portion height to which the heel end portion is adjusted.

* * * * *